United States Patent [19]

Schoenleber et al.

[11] Patent Number: 5,037,139

[45] Date of Patent: Aug. 6, 1991

[54] ADVERTISING SAMPLER AND METHOD OF MANUFACTURE

[75] Inventors: Donald W. Schoenleber, Bellemead; Frederick Grainger, West Greenbrook; Michael A. Parrotta, Hamilton Square, all of N.J.

[73] Assignee: Webcraft Technologies, Inc., North Brunswick, N.J.

[21] Appl. No.: 346,345

[22] Filed: Apr. 28, 1989

Related U.S. Application Data

[63] Continuation of Ser. No. 917,079, Oct. 8, 1986, abandoned, which is a continuation-in-part of Ser. No. 721,769, Apr. 10, 1985, abandoned.

[51] Int. Cl.[5] ..... B42D 15/00

[52] U.S. Cl. ..... 283/56; 206/538; 206/823; 283/100; 283/102; 283/903

[58] Field of Search ..... 283/56, 62, 100, 102, 283/903; 206/538, 235, 581, 823

[56] References Cited

U.S. PATENT DOCUMENTS

| | | | |
|---|---|---|---|
| 1,689,637 | 10/1928 | Mordecai | 281/15.1 |
| 1,743,512 | 1/1930 | Aisen | 132/79 D |
| 1,885,076 | 10/1932 | Bustamante | 132/79 D |
| 1,888,314 | 11/1932 | Framke | 132/79 D |
| 2,061,139 | 11/1936 | Cohen | 206/538 |
| 2,185,386 | 1/1940 | Valentine | 206/823 X |
| 2,561,400 | 7/1951 | Morrell | 132/79 D |
| 2,802,569 | 8/1957 | Massey | 206/462 |
| 4,125,190 | 10/1978 | Davey, Jr. et al. | 206/462 |
| 4,466,534 | 8/1984 | Dunn | 206/462 |
| 4,751,934 | 6/1988 | Moir et al. | 132/79 D |
| 4,752,496 | 6/1988 | Fellows et al. | 427/27 |
| 4,824,143 | 4/1990 | Grainger | 281/15.1 |
| 4,890,872 | 1/1990 | Parrotta et al. | 283/56 |

*Primary Examiner*—Paul A. Bell

*Attorney, Agent, or Firm*—Shlesinger Arkwright & Garvey

[57] ABSTRACT

A flat paper sheet advertising sampler has a base panel with a thin readily removable rub-off transfer layer, a spacer panel overlying the base panel and having an access opening in registry with the transfer layer, and a moveable cover panel hingedly connected along a common edge with the base panel which overlies the spacer panel and its access openings when the cover panel is in a closed position.

33 Claims, 4 Drawing Sheets

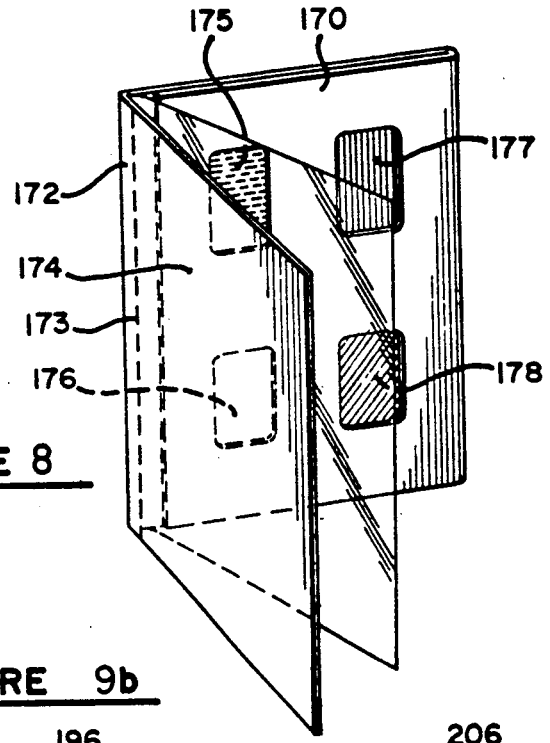
FIGURE 8
FIGURE 9a
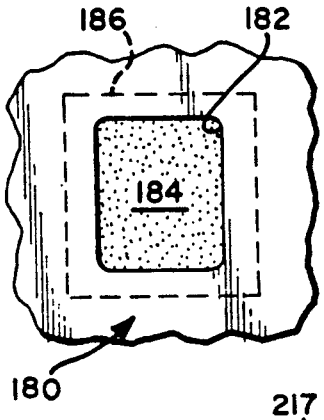
FIGURE 9b
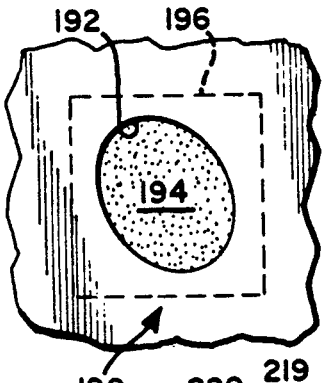
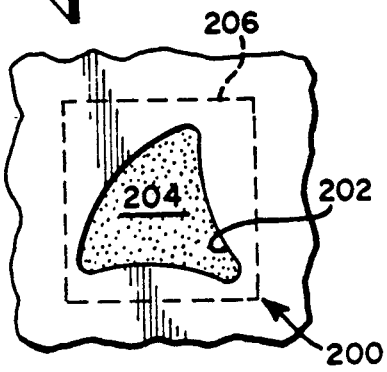
FIGURE 9c
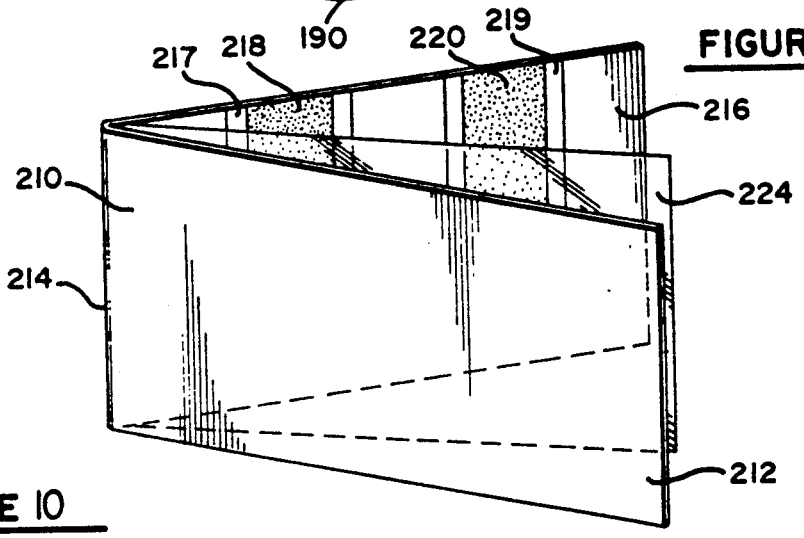
FIGURE 10

ADVERTISING SAMPLER AND METHOD OF MANUFACTURE

This invention relates to low cost mass produced advertising sample pieces; it is a continuation of U.S. application Ser. No. 917,079, filed Oct. 8, 1986, which is a continuation-in-part of copending U.S. application Ser. No. 721,679 filed Apr. 10, 1985, now abandoned.

BACKGROUND OF THE INVENTION

The particular product and article of manufacture is a single pass manufactured article of paper sheet material which is conditioned to accept an applied layer of material representative of the product being advertised.

There is a large market for flat, thin sheet advertising samplers containing a thin film of product sampling material. Such items can be included in magazines as bind-in inserts, in mailing pieces, and in catalogs.

Essential requirements of compact thin sheet structure, and inexpensive cost per item are essential requirements for such an advertising piece. Heretofore, this has not been attainable.

In the past, sample packages have been marketed in different arrangements, but these were neither compact, nor thin sheet pieces, and were not adaptable to the mass market advertising using paper folders and advertising pieces which were mass distributed.

There is a particular market for such advertising pieces by national advertisers who have extensively advertised their products in newspapers and magazines, particularly cosmetic manufacturers.

It is recognized that the ability of the perspective customer to actually sample and buy the product would greatly enhance the impact of the advertised product. It is to this particular market that the subject invention is particularly directed.

SUMMARY OF THE INVENTION

Accordingly, it is a principal object of this invention to provide a new type of advertising piece which contains a sample of the composition being advertised.

It is a further feature of this invention to provide a cosmetic advertising sampler which can be mass produced inexpensively and subsequently distributed as an ordinary paper advertising piece.

It is a still further object of this invention to provide an advertising sampler which substantially increases the sales advertising capability of flat sheet advertising pieces by including a representative sample of the item being advertised, and which can be readily tried by the user.

The sampler disclosed herein is a flat sheet paper product having the unique feature of a thin layer of removable sampling composition which is yet thick enough to avoid the necessity of overprinting the stock which color to maintain the transfer layer true in color to the actual cosmetic regardless of paper color. Previously, the transfer layer thickness was insufficient to prevent the paper color, e.g. white, from altering the color of the transfer layer. The color of the paper would bleed through thus, the sample would not be accurate of the actual cosmetic without there being an overprinting of the true color under the transfer layer so as to match the actual cosmetic.

A further feature of a sampler advertising piece of this invention is its versatility of arrangement and formats available to the advertiser, including multiple sampling capability for several comparable products, such as eyeshadow, blushes, skin coloring, and lipstick.

The construction of the sampler advertising piece makes it possible to provide the required sample in a simple flat sheet format, which can readily be mass produced, preferably in a single pass web printing and forming process.

The paper sheet to be used for such a cosmetic sampler is modified to accept material readily without bleeding through the thin paper stock, and to readily permit the layer of sampling material to be readily removed by light rubbing.

The composition is wet printed on the paper stock leaving a residual dry or semi-solid layer of a liquid formulation which is applied by in-line processes to the paper material and readily dries to a sufficiently cohesive layer of sample material and matches the principal color characteristics of the actual product being advertised.

The manufacture of such article is effectively carried out by an in-line manufacturing process using printing and forming techniques of web production which are integrated with additional particularized coating and fabrication techniques to produce a flat, thin advertising piece as described herein.

An object of this invention is to provide sufficient clearance of the applied cosmetic layer to avoid smearing or transfer of the cosmetic layer to the upper cover sheet when large numbers of articles such as newspaper or magazines, having the advertising sampler therein, are stacked.

Yet another object is to provide a carrier for any commercial cosmetic, which will make it liquid for printing purposes which will not alter significantly the true color of the cosmetic when the liquid is printed on the stock and dried or semi-solidified and the solvent evaporated, substantially from the cosmetic.

These and other features and advantages of the invention will become apparent from the following description and from the drawings.

DESCRIPTION OF THE DRAWINGS

FIG. 4 is a sectional view along line 4—4 of

FIG. 8 is a plan view of another form of a cosmetic sampler illustrating another arrangement of sampling areas.

FIGS. 9*a*, 9*b*, and 9*c* are partial views with other possible shapes of sampling areas.

FIG. 10 is a perspective view of another sampler configuration.

DESCRIPTION OF THE INVENTION

Figure 1:
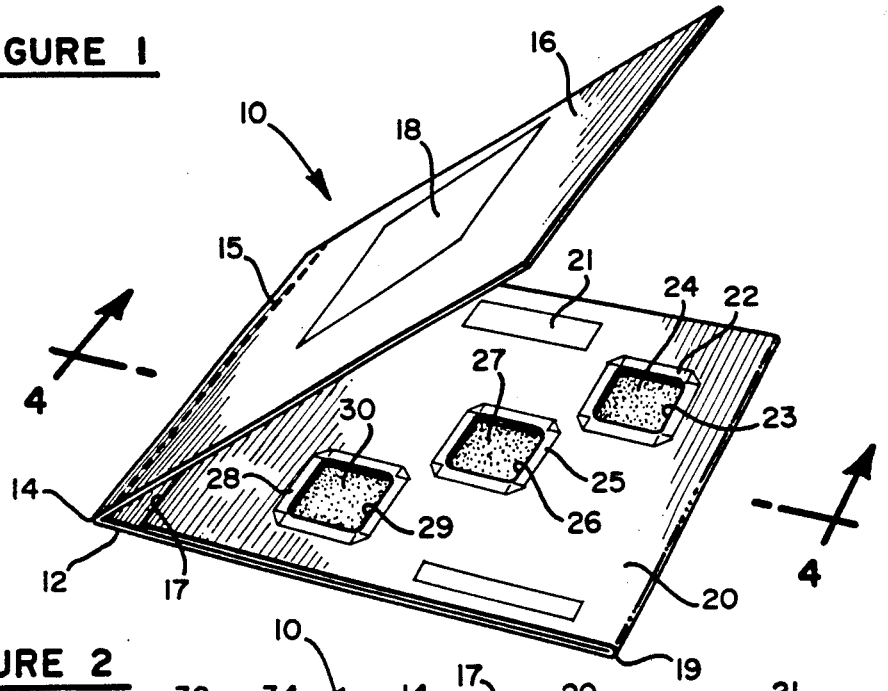
FIG. 1 is a perspective view of a cosmetic advertising sampler.
Figure 2:
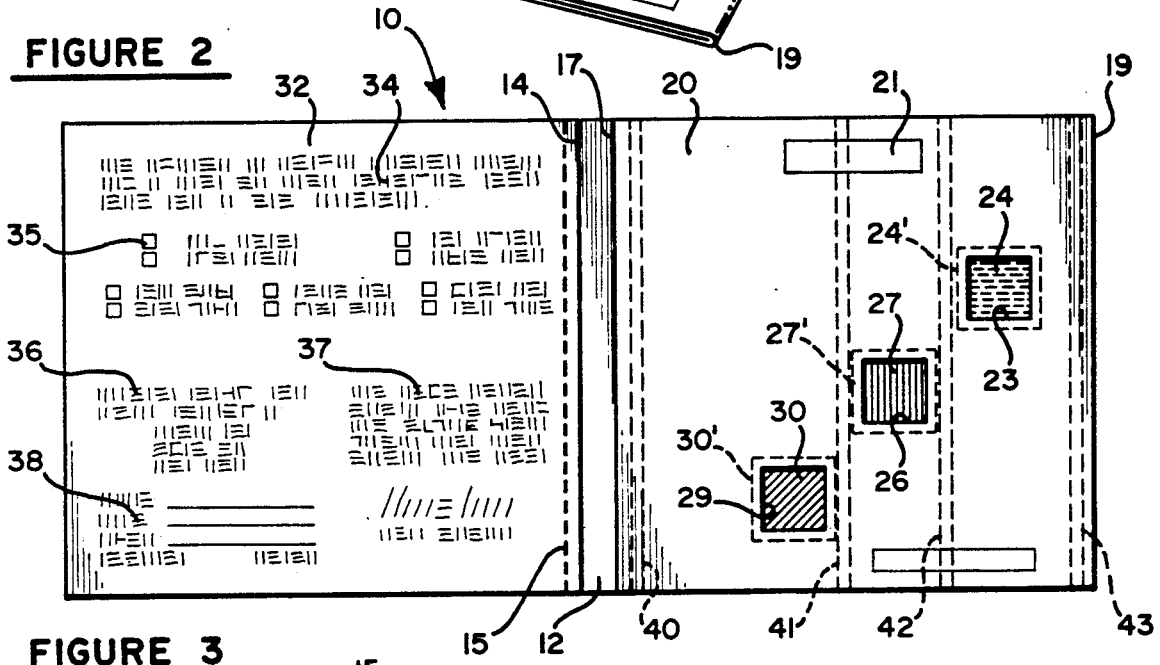
FIG. 2 is a top plan view of the opened sampler of FIG. 1 as it would appear to a use showing the inner surface.
Figure 3:
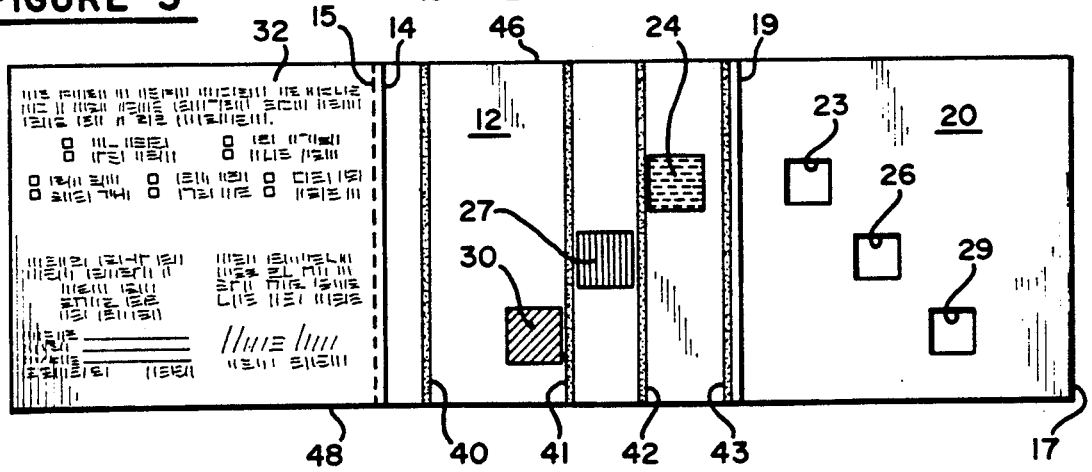
FIG. 3 is a top plan view of the advertising sampler in a flat opened state with the two glue panels separated.
Figure 4:
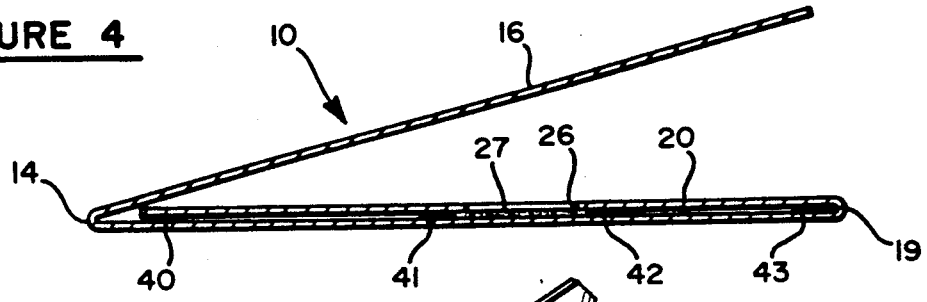

A cosmetic sampler advertising piece is shown in FIG. 1 in perspective, and in further detail in FIGS. 2 through 4. This cosmetic advertising sampler is characterized by its flat, thin configuration, the cosmetic sampling layer, and individual die-cut openings which surround the cosmetic sampler material.

Referring particularly to the drawings and the details of construction, the sampler generally indicated at 10 has a central base panel 12 to which a covering advertising panel 16 is hingedly connected along fold line 14. It contains general advertising material 18 on its outer surface and coupon order material on its inner surface; it is removably detachable along a perforated line 15.

The central panel 12 which contains the cosmetic sampler material supports a spacer advertising panel 20 to which it is integrally connected along line 19. The edge 17 helps the spacer panel 20 extend to fold line 14 and is spaced therefrom.

The reference advertising material generally indicated at 21 refers to the sampler composition contained on the panel.

The three cosmetic samples of different colors are accessible through openings in spacer panel 20. The well openings on the spacer panel can be arranged in any desired manner or number, however.

Referring to the spacer panels 20, the top sampling composition is shown within a printed container 22 which has a die-cut opening 23 through which the transfer layer 24 of cosmetic sampler material disposed on underlying base panel 12 can be reached.

The sampling composition is a transfer layer which gives an accurate color match for the cosmetic being advertised. It can be used to give an accurate color match for brushes, eyeshadow, skin cream, body coloring materials, and hair coloring.

The important quality of the transfer material is the ability to be removed from the advertising sampler by moderate rubbing pressure and then easily reapplied to the skin surface and to give an accurate color match is desired. In this manner, an accurate color match to the cosmetic product advertised on the cosmetic sampler advertising piece, is obtained.

This sampler contains a different color transfer layer in each well. The transfer layer 24 is a gray color.

The intermediate sampler has a printed container outline 25 and die-cut well opening 26 is a red or pink transfer layer composition.

The third transfer layer composition 30 is shown in the printed container outline 28 and accessible through die-cut opening 29. It is a brownish colored transfer layer composition.

The inner face 32 of panel 16 contains order information generally indicated at 34. Plural selection boxes 35 could be used by the customer. Other information 36, and an additional message 37 is also contained on the panel. A plurality of spaces for the return address of the customer and other relevant information is provided at 38. The page 32 can be severed along perforated lines 8 and 15 and returned to the advertiser.

It will be noted that the spacer panel 20 is folded about line 19 and over panel 12 to cover the three blocks of transfer layer 24, 27 and 30. The paper material is calendered stock 70 pound weight which has a smooth surface, and on which the cosmetic transfer layer material lightly adheres, without bleeding through the paper stock. It will be noted that the well-openings 23, 26 and 29 are smaller in outline than in the actual periphery of the transfer layer edges as indicated in FIG. 2 where the outer peripheries 24', 27' and 30' of their respective patches 24, 27, and 30 extend beyond the die-cut openings. In this manner, the well opening which is formed by a precise die-cut in the forming operation provides an accurate well-opening size of the desired shape. The base panel 12 contains adhesive glue strips 40, 41, 42 and 43 which secured hold the base panel and spacer and well panel 20 together.

The cross-sectional view of FIG. 4 shows the arrangement of the cosmetic layer and the glue layers in this composite panel construction. The cosmetic transfer layer sample patch areas which are exposed through the well openings are sufficiently large areas for the prospective customer to obtain a good sample of the layer on the fingertip and to apply it to several sample test areas on the skin. Different color transfer layers would represent different color shades of the advertised product. The calendered surface of the paper used seals the paper sufficiently to prevent bleed-through. The transfer layer is from 3–4 thousandths of an inch thick, preferably. Although this dimension may be varied somewhat.

Problems are encountered ordinarily with any product that is applied to the paper in a wet state, and particularly to compositions that include wax or oil. To avoid this problem which is encountered with uncoated paper stock, a calendered paper is used as the stock for this sampler.

The smooth surface of the stock also provides a non-adhering surface. Inner surface 32 of panel 16 which will prevent the dried composition transfer layers top surfaces from smudging off onto half panel inner surface because of its slickness. Consequently, the use of calendered paper stock provides the two-fold advantage, in that it provides the pop-up substrate surface on panel 12 on which the transfer layer compositions can be applied in the wet stage without concern for bleed-through, and also permits removal of the transfer layer by relative ease with a light rubbing action of the finger tip, while the slickness of the inner surface makes it possible to eliminate inclusion of an extra smooth transparent protective sheet in the most cases.

In the case of eyeshadow, blushes, skin coloring and the like, the transfer layer after hardening forms a compact, thin, dry, paste-like solid suspension layer of cosmetic material which, depending upon the composition used, can range from 2 to 12 thousandths of an inch, depending upon the composition and blend of constituents.

It will be noted that the structure of this sampler does not require the barrier layer described in the parent application, and that the calendered stock provides a sufficiently smooth and non-porous surface which permits the entire surface of the paper to receive the transfer layer composition.

The spread open plan view of FIG. 3, with omission of the fold lines 14, 19, perforate line 15 and the transfer cut lines 46 and 48 would show the appearance of each successive sampler piece on the web prior to folding, perforation and transfer separation of the successive cosmetic sampler advertising pieces from the work.

The use of a new type of transfer layer with little oil or wax in the Composition makes it possible to use light, smooth surfaced calendered stock, omitting the barrier layer, and also to reduce the thickness of the transfer layer, which has enhanced characteristics in rub-off, smoothness, and printability.

Figure 5:
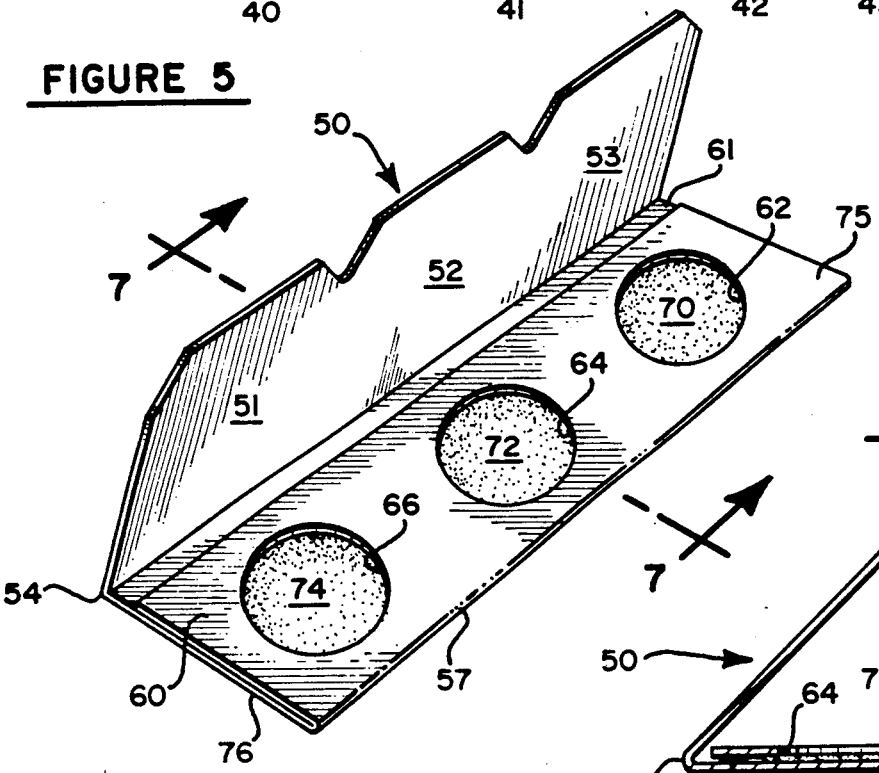
FIG. 5 is a perspective view of a second modification of an advertising sampler.
Figure 7:
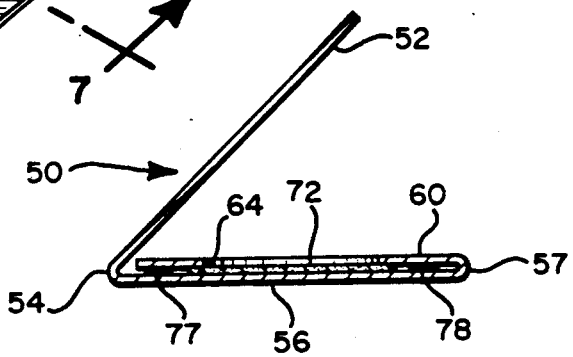
FIG. 7 is a sectional view along line 7—7 of FIG. 5.
Figure 6:
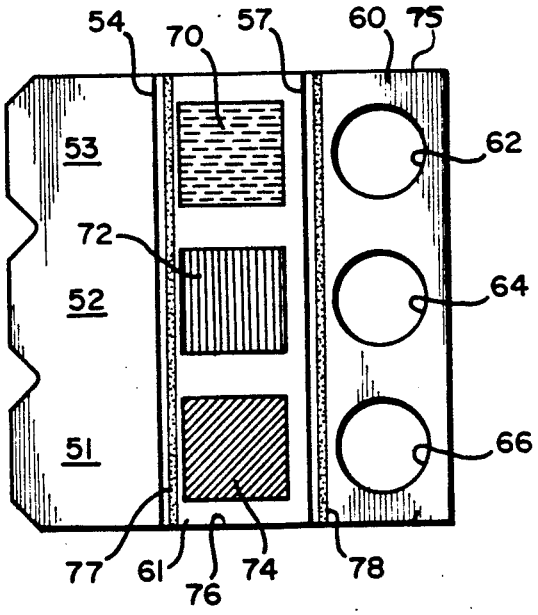
FIG. 6 is a top plan view of the sampler of FIG. 5 with the glued panel separated.

Another cosmetic sampler configuration is shown in FIGS. 5 through 7. The sampler 50 is in the form of a multiple well compact, made from single sheet paper stock as the prior format of FIG. 1.

The cosmetic sampler 50 has three well Cover sections 51, 52 and 53 on the cover panel. It is connected to the base panel 56 by fold line 54. The base panel 56 is connected to spacer well panel 60 along fold line 57. The other edge 61 is displaced from the fold line 54. The separator panel 60 has three circular wells 62, 64 and 66 for the three different colored cosmetic sample transfer layers 70, 72 and 74. Note that the three transfer layer color samples of gray 70, red 72, brown 74 are generally square in outline, when applied to the base panel 56, as indicated in FIG. 6 It will also be noted that the samples are in direct longitudinal alignment and not laterally spaced as in the cosmetic sampler of FIG. 1. Variations in arrangement of different color patches on the base panel are possible.

The opened sampler sheet showing the sampler of FIG. 6 with the panels 56 and 60 separated from each other and in open view also shows, in addition to the fold lines, the glue lines 77 and 78. This view is similar to that of FIG. 3. Separation of the successive cosmetic sampler pieces from each other and the web from which they are made, is made by a transverse cut of the finished sample piece which produces the transverse edges 75 and 76 along line 7—7 is shown in FIG. 7. Note fold line 57, transfer layer 72, and glue strips 77 and 78 which hold the panels 56 and 60 together.

In general various well known printing techniques can be used in the manufacture of the samplers 10 and 50. Web stock, or piece stock may be used and the layers 70, 72 and 74 applied by the usual transfer printing techniques with subsequent drying by air, heat etc. to reduce stock penetration.

SAMPLER CONSTRUCTION FOR NON-LIPSTICK COSMETICS

FIG. 8 discloses a simple bind-in single sheet sampler 170 having a bind-in strip 172 and a perforate separation line 174. This would permit the insertion of the sampler into a magazine, and the removal of the pamphlet by tearing along the perforated line 174 to free the piece from the magazine. Another arrangement of sampler patches is shown in this piece with transfer layer patches 175 and 176 of different color being in line, and corresponding patches 177 and 178 of two other colors being in line to complete a four block square arrangement of cosmetic sample layers. To produce this in-line arrangement, applicator wheels 84 and 116 would be positioned in line with each other to produce blocks 177 and 178. A clear sheet of cellophane or mylar is used here to protect the surface of the transfer layers. This is used where the paper is not calendered.

The versatility of the die-cut well arrangement is shown in FIGS. *9a*, *9b* and *9c*, which illustrate three different well configurations that are possible. FIG. *9a* shows a cut-away piece 180 of the cosmetic sampler composition layer 184 outlined by die-cut well 182 of the top panel. Note the dotted outline 186 of the transfer layer which is deposited on the underlying base panel. The well makes it possible to provide a very accurate outline, one of any desired configuration, including the rounded corners of the generally rectangular well 182.

FIG. *9b* shows a partial cut-away section 190 of an advertising sampler using an oval-shaped well configuration 192 with the cosmetic sampler layer 194. Note the outline of the generally rectangular applied layer 194 on the base panel and under the separator panel. It should be noted that the applicator assembly may be designed to produce a rectangular shape of varying length or width as desired.

A very complex and special shaped curved triangular configuration for a cosmetic sampler well is shown in FIG. *9c*. The partial cut-away section of the advertising sampler Contains a curved triangular die-cut well outline 202 which defines the periphery of the exposed surface of the transfer layer 204. Note the dotted outline of the generally rectangular outline of the transfer layer applied to the base panel and covered by the separated-well panel of the cosmetic sampler.

FIG. 10 discloses another sampler configuration generally indicated at 210 and having a cover panel 212 joined along a fold line 214 to a base panel 216 containing two elongated patches of transfer layer material 218 and 220. There are no wells on this piece, and the sample layer simply extends from top to bottom of the relatively narrow sampler piece. An intermediate clear strip of cellophane or mylar sheet 224 is secured to the panel 216 and serves to give protection to the two color transfer layer strip surfaces 218 and 220.

APPLICATION OF TRANSFER LAYER FOR NON-LIPSTICK COSMETICS

Ordinary paper stock is not suitable for reception and use of most transfer layers. If oil material in a cosmetic formulation is high, the paper may be sealed by calendering or clay coating to prevent oil from passing through into the paper and out of the composition.

Oil transfer has also been overcome by providing a barrier layer to ordinary paper stock which, as described in the previous parent application, is applied in a liquid state as a slurry which when dry provides a clear coating of the water borne or of the solvent-borne types. This coating was dried by ultra-violet radiation mercury arc lamps.

However, it is also possible to use calendered paper stock or clay coated or a calendered paper which serves to prevent bleed-through and absorption by the paper stock.

With cosmetic products, such as eyeshadow, the color pigments of a particular manufacturer are obtained as a dry powder material and are mixed to provide a liquid composition which can readily be applied as a thin liquid layer to the web, quickly dries, and has the desired color and other characteristics which closely match the actual product of the manufacturer.

In the parent case, the preferred cosmetic liquid composition is 20 to 40 by weight of cosmetic powder, with a possible extension of the range to 60% depending upon the composition of the cosmetic powder, and to 20% high functionality alcohol such as glycol or a polymeric wax such as a carbo-wax, 3 to 8% Water, and from 1 to 10% cellulosic binder, and 20 to 60% of an anhydrous alcohol which volatizes, leaving the remaining constituents as the dried transfer layer. Glycol is preferably the alcohol used for the volatile suspension agent.

Another cosmetic formulation has been developed that exhibits superior properties to that of the above formulation. The preferred percentage and high and low range percentages are as follows:

| | % | H | L |
|---|---|---|---|
| Cosmetic Powder | 35 | 70 | 15 |
| Fumed Silica | 2.0 | 5.0 | .1 |
| Methyl Glucamate | 3.0 | 10.0 | 1.0 |
| Anhydrous Alcohol | 59.4 | 83.84 | 9.0 |
| Preservative (Germabin) | .1 | 2.0 | .01 |
| Silicone (Methyl Siloxane) | .5 | 4.0 | .05 |

The silica provides a viscosity stabilizer and increases the viscosity range usable with the liquid product so that high viscosity values can be used (from 100 to 800 cps).

The silicone acts as an internal lubricant for the powder and as an anti-caking agent. The glucamate helps to form a loose adhesive bond for the powder particles.

Note that this composition has no heavy oil or wax-like constituent.

This formulation provides a more readily removable and more readily spreadable composition for the transfer layer.

The new formulation transfer layer has a dry cream-like consistency like the product and which wipes off clear and dry, and is not sticky. It has a quicker drying time (2 seconds vs. 4 seconds). The transfer is 2 to 3 times better, and has a smoother application to other surfaces. The viscosity of the original formulation when applied is 50 to 100 cps while the viscosity of the second formulation is 600 cps. The transfer layer is 70% cosmetic powder, 8% fumed silica 20% glucamate, and about 1% silicone. It is applied to 50 to 70 pound offset coated stock which has either a glazed rubber coating, or a clay coating. The transfer layers are preferably 0.003 to 0.005 inches thick since, if it is too thick, it will not pack, and if it is too thin, it will not effectively transfer.

The glucamate acts as a gel. The silicone acts as an internal lubricant and releasing agent. The fumed silica is a 5 micron size particle and promotes adhesion. The alcohol is a volatile solvent, which is a 3 to 10 carbon alcohol. Aliphatic and chlorinated solvents are also usable. The preferred paper stock for the advertising sampler is 70 pound weight super calendered clay stock.

Figure 11:
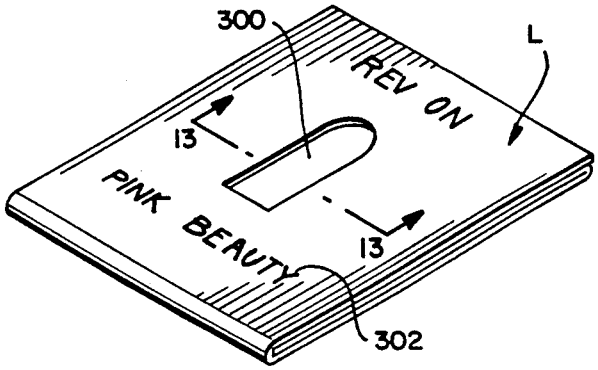
FIG. 11 is a perspective view of a further embodiment of this invention.

In the case of lipstick, the transfer layer will form after chilling, a semi-solid layer of lipstick. Preferably, the liquid lipstick transfer layer composition will be applied to a WOGR stock (water, oil, grease resistant) due to the oils and waxes in the base cosmetic lipstick. Thus, bleeding is avoided. In FIG. 11, the lipstick sampler L includes a window 300 shaped like a lipstick. Advertising may be included thereon. The insert will include these, if necessary, perforation lines for tear off as in FIGS. 1, 2 and 3, or flaps (not shown) for interleaving in a newspaper or magazine.

Although the sampler L is shown as being folded, it may be made with well known lamination techniques used during the printing process.

Since the lipstick transfer layer will be thicker than that of the other cosmetic transfer layers, additional clearance will be needed to maintain out-of-contact with the cover layers.

Figure 12:
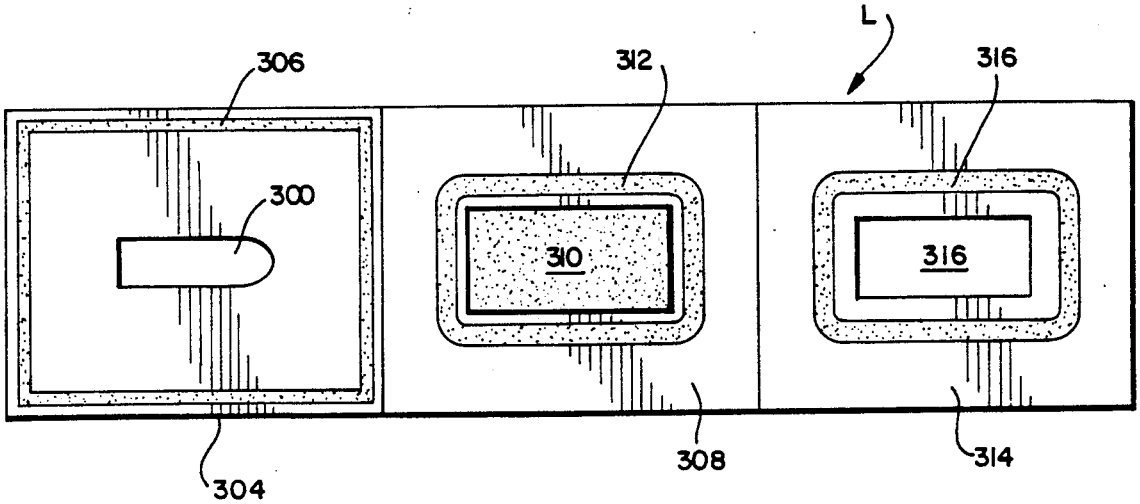
FIG. 12 is a top plan view of the sampler of FIG. 11 prior to folding.
Figure 13:
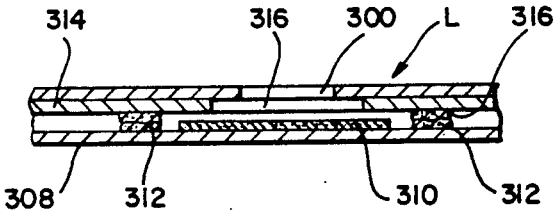
FIG. 13 is a fragmentary cross-sectional view of the sampler shown in FIG. 11 and viewed in the direction of the arrows.

In FIG. 12, the end panel 304 having the cut-out 300 includes on the inside surface thereof an adhesive layer 306. An intermediate panel 308 includes the transfer layer 310 which is printed on the solid intermediate panel 308. About the transfer layer 110 is provided a raised coating 312. The coating 312 is applied by printing techniques and includes a blowing agent causing the area on which the coating 312 is applied to swell. This will allow for some spacing around the lipstick transfer layer 310. The other end panel 314, also includes a coating 316 having a blowing agent therein for permitting additional separation of the panel 314 from the panel 308 when the two panels are overlayed as shown in FIG. 3. A window 316 is provided in the panel 314 which is larger in width than the window 300 in the panel 304. This permits ease in application of the finger or a lipstick brush for test application to the skin or lips.

In the preparation of the transfer layer composition for use in the printing on the sampler, the standard commercial lipsticks are mixed with the following ingredients for printing on the sampler in liquid form subsequently to be dried and semi-solidified by chilling and/or evaporation.

| | Maximum % | Optimum % | Minimum % |
|---|---|---|---|
| fumed silica | 1 | ½ | .1 |
| glucamate | 2½ | 2 | .5 |
| Alcohol | 35 | 30 | 25 |

Less than 2% cerasin wax may be added to increase the solidity of the lipstick transfer layer.

The cosmetics including lipstick in general all include a percentage of powder, though in the case of lipstick, it is a smaller percentage with principal ingredients of waxes, oils etc.

It is important to note that in all samplers, lipstick or otherwise, the transfer coat is sufficiently opaque so as to avoid any underlying or adjacent paper color (usually white) to cause said transfer layer color to be different in color density from the actual cosmetic it is intended to display. An object of this invention is to print a sufficient amount of cosmetic compound on the paper stock to avoid a color change due to the interference of the paper color itself adjacent to and beneath the transfer layer.

Besides the lower both aliphatic and aromatic, alcohols, other evaporating agents such as chlorinated hydrocarbons may be used in the percentages set out and preferably above about 35% by weight of the total compositions depending on the type cosmetic used.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention of the limits of the appended claims.

What is claimed is:

1. A thin, paper sheet cosmetic advertising sampler comprising:

a) a paper sheet having at least one relatively small sampling area having a smooth relatively non-porous relatively impermeable non-bleed through surface, b) a thin, relatively cohesive smooth printed transfer layer of a powder bearing cosmetic material lightly adhering to said sampling area without bleeding through said paper sheet surface, c) said paper sheet at least in the area bout and under said transfer layer, being of a color substantially different from that of said cosmetic material in said transfer layer, d) said transfer layer having a thickness sufficiently dense in said transfer area, so as to be opaque to said area under said transfer layer, thereby to avoid said paper color from diluting the color of said transfer layer and preventing said transfer layer from accurately displaying the color of said cosmetic material, e) said transfer layer being such that a light rub from a receiving surface will cause a sufficient amount of said transfer layer to leave said sampling are and adhere to said receiving surface from which it can be readily spread onto the skin of the user, f) a cover panel secured to said paper sheet and covering at least a portion of said transfer layer, and g) the transfer layer is a mixture having as a principal constituent a cosmetic coloring powder in homogeneous suspension with a viscosity stabilizer, and an internal lubricant.

2. A thin paper sheet cosmetic advertising sampler as in claim 1 and wherein:

a) said paper sheet is clay coated stock.

3. A thin paper sheet cosmetic advertising sampler as in claim 2 and wherein:

a) said paper sheet is calendered paper stock.

4. A thin paper sheet cosmetic advertising sampler as in claim 2 and wherein:

a) said paper sheet is water, oil, grease resistant (WOGR) stock.

5. A thin paper sheet cosmetic sampler as in claim 2 and wherein:

a) said transfer layer includes, in addition to said cosmetic material, a small amount of a volatile solvent residue remaining subsequent to printing said transfer layer on said sampler.

6. A thin paper sheet cosmetic advertising sampler as in claim 2 and wherein:

a) said paper sheet includes a base panel having said transfer layer printed thereon, and b) said cover panel completely covers said transfer layer.

7. A thin paper sheet cosmetic advertising sampler as in claim 6 and wherein:

a) said base panel has mounted thereon an spacer panel having a window therein which encompasses a substantial portion of said transfer layer, b) said transfer layer having a marginal area, and c) said spacer panel overlying said transfer layer area.

8. A thin paper sheet cosmetic advertising sampler as set forth in claim 7, wherein:

a) said spacer panel includes a window having an outer marginal edge surface, and b) said window overlies said transfer layer, and c) a cover panel which is positioned overlies and covers said window, and is moveable to an open position which exposes said window.

9. A thin paper sheet cosmetic advertising sampler as in claim 8, and wherein:

a) said cover panel and said spacer panel each includes spacer means adjacent said spacer panel window for spacing said base panel from said spacer panel, whereby said transfer layer is substantially beneath the outer marginal edge surfaces of said spacer panel.

10. A thin paper sheet cosmetic advertising sampler as in claim 9 and wherein:

a) said spacer means is raised set pour formed plastic compositions having its pores produced by a flowing agent.

11. A thin paper sheet cosmetic advertising sampler as in claim 8 and wherein:

a) said cover panel window is shaped in the configuration of a lipstick.

12. A flat, thin, multi-panel paper sheet cosmetic advertising sampler formed from a continuous web, comprising:

a) a paper sheet ;having base, spacer, and cover panels at least one of which has conventionally printed advertising thereon referring to a cosmetic advertised product to be sampled by a prospective customer, b) the base panel having at least one relatively small sampling area which has a smooth non-porous impermeable surface on which material can be deposited, and which will prevent bleed-through, c) a thin, dry, cohesive and appliable rub-off transfer layer which is a film of a powder bearing cosmetic suspension material which lightly adheres to the smooth non-porous surface without bleeding through the paper, and accurately matches the color and to some degree general characteristics of the cosmetic product referred to in the printed advertising, d) the transfer layer having a thickness slightly greater than that of the paper sheet, and adhering lightly to the smooth surface of the sampling area such that a light rub from a receiving surface will cause the layer to leave the smooth surface of the sampling area and to stick to the receiving surface, from which it is readily spreadable onto the skin of the user, e) a spacer panel overlying the base panel and having an access opening therein disposed in registry with the transfer layer to expose it in a recessed configuration, f) a cover panel integrally connected to the base panel so as to overlie the transfer layer in closed position, and from which it can be readily moved to open position to provide access to the transfer layer, and g) the cover panel surface adjacent the transfer layer being sufficiently smooth to preclude an adherence to the transfer layer when they come into contact.

13. The thin, paper sheet cosmetic advertising sampler as set forth in claim 12, wherein:

a) the coating is a barrier layer which is particularly applied to the sampling area to impart the required smooth, non-porous texture to the surface of the base panel.

14. The thin, paper sheet cosmetic advertising sampler as set forth in claim 12, wherein:

a) the entire surface of the base panel is calendered, and to provide a coating and is sufficiently smooth and non-porous so as to provide the required smooth, non-porous texture to the surface of the base panel of the paper sheet.

15. The thin, paper sheet cosmetic advertising sampler as set forth in claim 12, wherein:

a) the area of the transfer layer surface is approximately twice that of a fingertip.

16. The thin, paper sheet cosmetic advertising sampler s set forth in claim 12, wherein:

a) there are a plurality of sampling areas on the base sheet each of which contains sampling area contains different colored transfer layer.

17. The thin, paper sheet cosmetic advertising sampler as set forth in claim 16, wherein:

a) the cover sheet is a panel which is hingedly connected along a common fold line to the paper sheet which is an adjacent panel.

18. The thin, paper sheet cosmetic advertising sampler as set forth in claim 17, wherein:

a) the cover panel contains advertising referring to the cosmetic product being advertised.

19. The thin, paper sheet cosmetic advertising sampler as set forth in claim 18, wherein:

a) one face of the cover panel has an order form printed thereon, and b) the cover panel is readily disconnected from the paper sheet containing the transfer layer.

20. The thin, paper sheet cosmetic advertising sampler as set forth in claim 18, wherein:

a) a bind-in strip is connected along a side of at least one of the sheets.

21. The thin, paper sheet cosmetic advertising sampler as set forth in claim 17, wherein:

a) at least two transfer layers of different color are disposed in line with each other and parallel to the fold line.

22. The thin, paper sheet cosmetic advertising sampler as set forth in claim 12, wherein:

a) the transfer layer is a dried residue of its components ;and ;a volatile solvent which acted as a liquifier and particle suspension vehicle.

23. The thin, paper sheet cosmetic advertising sampler as set forth in claim 22, wherein:

a) the solvent is a 3 to 10 carbon alcohol.

24. The thin, paper sheet cosmetic advertising sampler as set forth in claim 22, wherein:

a) a major component of the transfer layer is a cosmetic powder.

25. The thin, paper sheet cosmetic advertising sampler as set forth in claim 12, wherein:

a) the transfer layer is from 0.002 to 0.012 in thickness.

26. The thin, paper sheet cosmetic advertising sampler as set forth in claim 12, wherein:

a) there are plurally sampling areas on the base panel sampling area contains different colored transfer layer, and b) the cover panel which is hingedly connected along a common fold line to the adjacent base panel.

27. The thin, paper sheet cosmetic advertising sampler as set forth in claim 12, wherein:

a) there are plural sampling areas on the base panel each sampling area contains different colored transfer layer.

28. The thin, paper sheet cosmetic advertising sampler as set forth in claim 12, wherein:

a) the cover panel which is a piece hingedly connected to one of the other panels along a common fold line.

29. The thin, paper sheet cosmetic advertising sampler as set forth in claim 12, wherein:

a) at least two transfer layers of different color are disposed in line with each other and parallel to the juncture of the additional and paper sheets along a fold line.

30. The thin, paper sheet cosmetic advertising sampler as set forth in claim 12, wherein:

a) the periphery of the spacer panel openings can have any desired outline.

31. The thin, paper sheet cosmetic advertising sampler as set forth in claim 12, wherein:

a) the transfer layer is a mixture having as a principal constituent a cosmetic coloring powder in homogeneous suspension with a wax and a binder.

32. The thin, paper sheet cosmetic advertising sampler as set forth in claim 12, wherein:

a) the transfer layer is a mixture having as a principal constituent a cosmetic coloring powder in homogeneous suspension with an oil and a binder.

33. The thin, paper sheet cosmetic advertising sampler as set forth in claim 12, wherein:

a) the transfer layer is a mixture having as a principal constituent a cosmetic coloring powder in homogeneous suspension with a methyl glucamate, a silicate, and a silicone.

* * * * *